US006206666B1

(12) United States Patent
Steinrock et al.

(10) Patent No.: US 6,206,666 B1
(45) Date of Patent: Mar. 27, 2001

(54) HIGH EFFICIENCY GEAR PUMP

(75) Inventors: James G. Steinrock; Jerry R. Barning, both of Columbus, IN (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 09/062,717

(22) Filed: Apr. 20, 1998

Related U.S. Application Data

(60) Provisional application No. 60/070,299, filed on Dec. 31, 1997.

(51) Int. Cl.[7] ..... F04C 2/18
(52) U.S. Cl. ..... 418/110; 418/206.1
(58) Field of Search ..... 418/110, 182, 418/200, 206.1

(56) References Cited

U.S. PATENT DOCUMENTS

| | | | |
|---|---|---|---|
| 2,955,537 | 10/1960 | Gaubatz | 418/200 |
| 2,965,036 | 12/1960 | Wood | 418/200 |
| 3,272,140 | 9/1966 | Curry et al. | 418/200 |
| 4,259,045 | 3/1981 | Teruyama | 418/200 |
| 4,776,779 | 10/1988 | Crump | 418/200 |
| 5,092,751 | 3/1992 | Viktora | 418/200 |

FOREIGN PATENT DOCUMENTS

| | | | |
|---|---|---|---|
| 355193 | 6/1922 | (DE) | 418/110 |
| 609108 | 9/1948 | (GB) | 418/200 |
| 1420244 | 8/1988 | (SU) | 418/110 |
| 1495510 | 7/1989 | (SU) | 418/206 |

*Primary Examiner*—John J. Vrablik
(74) *Attorney, Agent, or Firm*—Nixon Peabody LLP; Charles M. Leedom, Jr.; Daniel W. Sixbey

(57) ABSTRACT

The high efficiency gear pump includes a pump housing which defines an internal pump chamber. The pump chamber includes opposed first and second elongate gear receiving sections spaced on opposite sides of a central chamber section. The first and second gear receiving sections each have an arcuate peripheral wall which extends between a low pressure inlet port and a high pressure outlet port positioned on opposite sides of the central chamber section between the first and second gear receiving sections. Coaxially mounted on a drive shaft for rotation therewith are first and second pump drive gears having teeth which rotate in minimal spaced relationship with the arcuate peripheral wall of the first gear receiving section. The first and second pump drive gears are mounted for floating axial movement relative to each other and the drive shaft. An idler shaft is mounted in substantially parallel spaced relationship to the drive shaft, and coaxially mounted for rotation on the idler shaft are third and fourth pump idler gears having teeth which mesh with the teeth of the first and second pump drive gears in the central chamber section. The teeth of the third and fourth pump idler gears rotate in minimal spaced relationship with the arcuate peripheral wall of the second gear receiving section. The third and fourth pump idler gears are mounted for floating axial movement relative to each other and the idler shaft.

12 Claims, 2 Drawing Sheets

HIGH EFFICIENCY GEAR PUMP

This application is based on Provisional Application Ser. No. 60/070,299 filed Dec. 31, 1997 and claims the benefit of the filing date of Provisional Application Ser. No. 60/070, 299 filed Dec. 31, 1997.

TECHNICAL FIELD

The present invention relates to gear pumps generally and more particularly to a unique gear pump having a floating split gear arrangement to enhance pump efficiency.

BACKGROUND OF THE INVENTION

In the past, gear pumps employing a meshed gear set have been used to draw fluid from an input or suction port within a pump housing and to pressurize and pass the fluid to an opposed output or pressure port within the pump housing. Conventionally, such gear pumps have included two elongate meshed gears extending longitudinally of the pump housing between the suction and pressure ports which are located on opposite sides of the meshed gears. The gears are mounted to rotate in gear pockets in the pump housing, and hypothetically when rotating seal against each other in the areas where the gear teeth mesh so that fluid from the suction port is carried around the perimeter of a gear pocket into the pressure port. This action pressurizes the fluid being delivered to the pressure port, and the resulting pressure gradient between the pressure and suction ports results in fluid leakage through any clearances present between the teeth of the meshing gears. These clearances invariably exist due to gear tooth lead error which is waviness or profile error of the involute along the length of the gear. Lead tooth error provides a fluid flow path which increases in area as the axial length of the gears increases, thereby resulting in degradation of the volumetric efficiency of gear pumps employing only two meshed gears.

The volumetric efficiency of known gear pumps is further degraded by fluid leakage between the suction and pressure ports around the ends of the gears. Thus gear tooth manufacturing lead error and the gear end clearance relative to the gear housing result in significant internal fluid pumping losses for a gear pump.

Gear pumps have often been employed as fuel pumps for internal combustion engines, and to meet demands for ever increasing fuel system efficiency, engine performance and lower emissions, it has become necessary to enhance the volumetric efficiency of gear type fuel pumps. To accomplish this, fluid leakage between the low pressure and high pressure portions of the pump must be minimized.

SUMMARY OF THE INVENTION

It is a primary object of the present invention to provide a novel and improved high efficiency gear pump for pressurizing and pumping fluid between a low pressure and a high pressure port while minimizing internal fluid leakage between these ports.

Another object of the present invention is to provide a novel and improved high efficiency gear pump employing split gears to reduce manufacturing gear tooth lead error and internal fluid leakage resulting therefrom.

A further object of the present invention is to provide a novel and improved high efficiency gear pump which provides improved volumetric efficiency by reducing the ability of gear end clearance to cause internal fluid leakage.

Yet another object of the present invention is to provide a novel and improved high efficiency gear pump employing two split coaxial drive gears and two split coaxial idler gears meshing with the drive gears. The split drive and idler gears are mounted for floating axial movement.

A still further object of the present invention is to provide a novel and improved high efficiency gear pump having a pump chamber with spaced endwalls. Two split coaxial drive gears and two split coaxial idler gears meshing with the drive gears are mounted for rotation within the pump chamber between the endwalls with the axes of rotation for the drive and idler gears being normal to the pump chamber endwalls. The split drive and idler gears are mounted for floating axial movement relative to each other and the pump chamber endwalls, and are separated by a single snap ring between each set of gears to insure sealing with the chamber endwalls.

These and other objects of the present invention are accomplished by providing a pump housing which defines an internal pump chamber having first and second spaced endwalls. Between the endwalls, the pump chamber includes opposed first and second elongate gear receiving sections spaced on opposite sides of a central chamber section. The first and second gear receiving sections each have an arcuate peripheral wall which extends between a low pressure chamber section or port and a high pressure chamber section or port positioned on opposite sides of the central chamber section between the first and second gear receiving sections.

A drive shaft is mounted for rotation on the pump housing to extend between the first and second endwalls of the pump chamber. Keyed to the drive shaft for rotation therewith are first and second pump drive gears having teeth which rotate in contact or close relationship with the arcuate peripheral wall of the first gear receiving section. This invention is not specific to any particular key design (woodruff, square, round, etc.). The feature or characteristic of importance is the fact that the key's fit does not prevent axial float of gears. The first and second pump drive gears are coaxially mounted for floating axial movement relative to each other and the pump chamber endwalls, and a single snap ring is positioned therebetween. An idler shaft is mounted in substantially parallel spaced relationship to the drive shaft on the pump housing to extend between the first and second endwalls of the pump chamber. Mounted for rotation on the idler shaft are third and fourth pump idler gears having teeth which mesh with the teeth of the first and second pump drive gears respectively in the central chamber section. The teeth of the third and fourth idler pump gears rotate in contact or close relationship with the arcuate peripheral wall of the second gear receiving section. The third and fourth pump idler gears are mounted for floating axial movement relative to each other and the pump chamber endwalls, and a single snap ring is positioned therebetween.

DETAILED DESCRIPTION OF THE INVENTION

Figure 1:
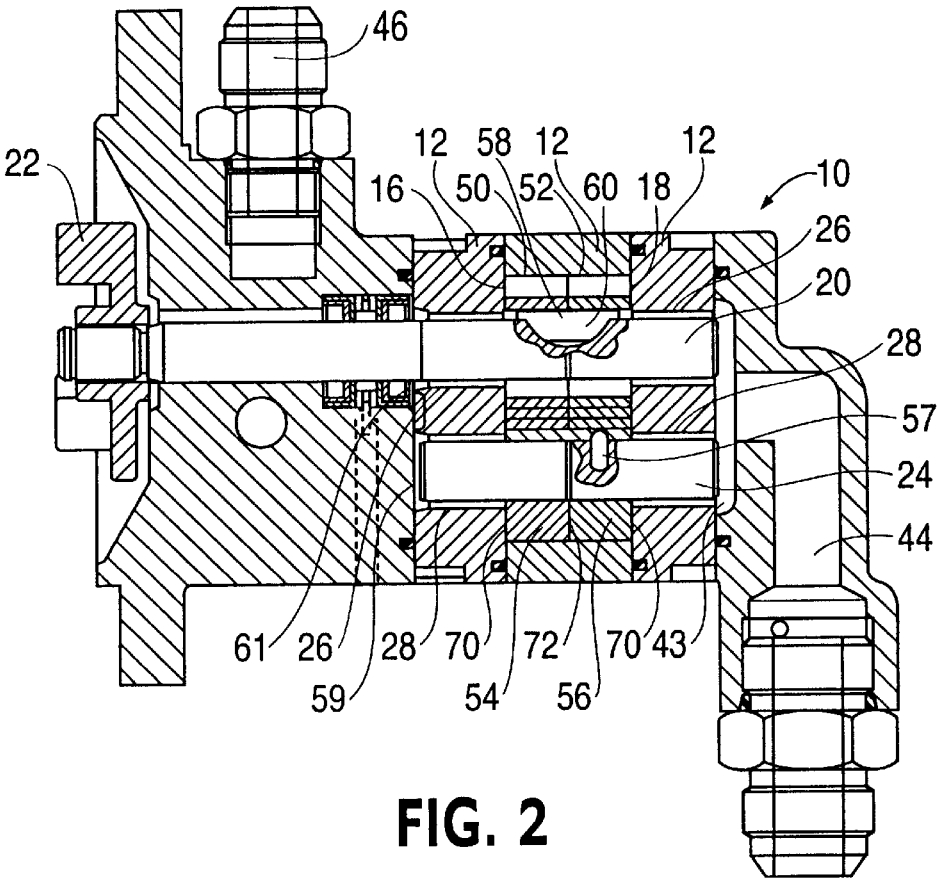
FIG. 1 is a longitudinal sectional view of the gear pump of the present invention.

Referring to the drawings, the gear pump of the present invention indicated generally at 10 includes a pump housing 12 which defines an internal pump chamber 14. The ends of the pump chamber are closed by spaced endwalls 16 and 18, and a rotatable drive shaft 20 which is mounted in the pump chamber 14 between the endwalls 16 and 18. The drive shaft extends externally from the pump housing and mounts a drive coupling 22 for an external drive assembly (not shown).

Extending across the pump chamber 14 substantially parallel to the drive shaft 20 and in spaced relation thereto is an idler shaft 24 which is mounted for rotation on the endwalls 16 and 18. Both the drive shaft and idler shaft may or may not be sealed to the endwalls 16 and 18 by shaft bearings 26 and 28. Plain bearings tend to restrict leakage due to small annular clearance, as in other designs employed by the Cummins Engine Company, Inc. Some pumps use needle bearings, which allow more flow. This invention is independent of this distinction.

The pump chamber 14 includes a first elongate gear receiving section 30 having an arcuate peripheral wall 32 and an opposed second gear receiving section 34 having an arcuate peripheral wall 36. The gear receiving sections extend between the endwalls 16 and 18 and open into a central chamber section 38 which also extends between the endwalls. On opposite sides of the central chamber section is a low pressure suction chamber section or port 40 and a high pressure chamber section or port 42. The low pressure suction chamber section is connected to an end chamber 43 which communicates with a fluid inlet 44 while the high pressure chamber section is connected to a fluid outlet 46. The low pressure suction chamber section is separated from the high pressure chamber section by a pump gear assembly 48 which includes two split pump gear sets which mesh in the central chamber section 38 and which are mounted on the drive and idler shafts.

The pump gear assembly 48 includes two drive gears 50 and 52 mounted on the drive shaft 20 in side by side coaxial relationship between the endwalls 16 and 18. These drive gears are preferably of equal size and have teeth which mesh with the teeth of idler gears 54 and 56 which are also preferably of equal size coaxially mounted on the idler shaft 24. These drive and idler gears are mounted for floating movement axially of the drive and idler shafts and form split, floating gear pairs.

Figure 3:
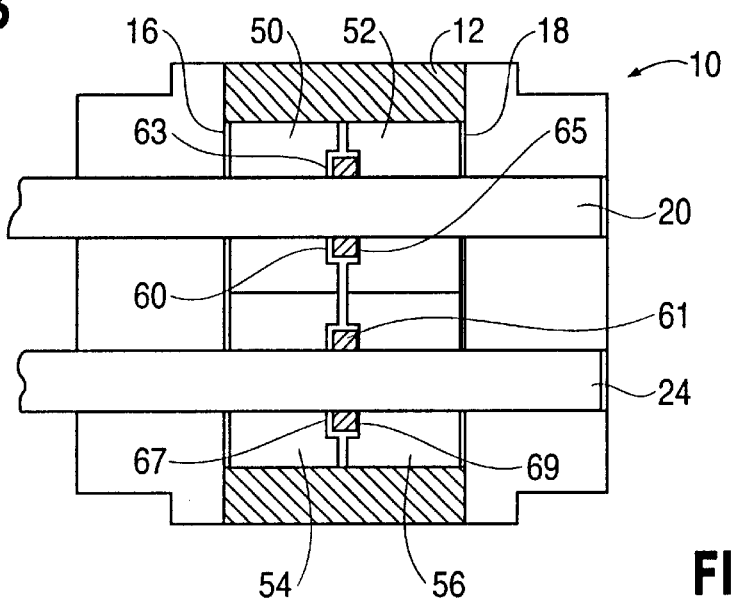
FIG. 3 is a longitudinal sectional view of the gear pump chamber of FIG. 1 showing the single snap rings separating the split gears.
Figure 5:
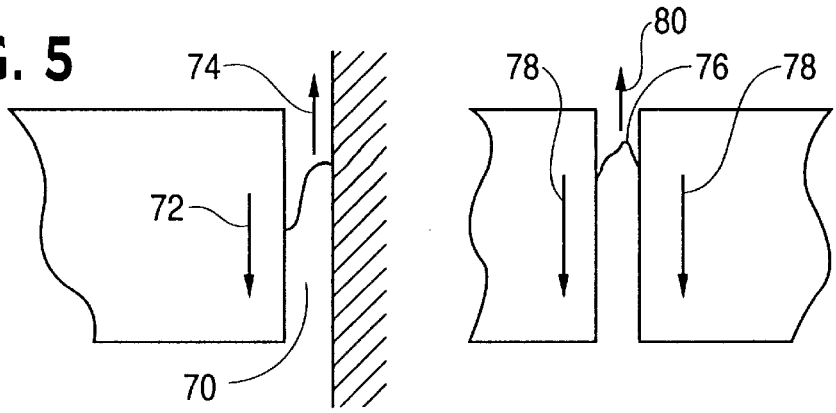
FIG. 5 is a diagram illustrating the improved end clearance leakage reduction provided by the gear pump of the present invention.

The drive gears 50 and 52 and idler gears 54 and 56 are dimensioned to extend across the pump chamber 14 between the endwalls 16 and 18 leaving a small clearance with the adjacent endwall at each end as shown in FIGS. 3 and 5. The drive gears are keyed to the drive shaft 20 by a key 58 which rides in a slot 62 in the drive shaft. This key and the slot 62 are configured to permit free axial movement of the drive gears along the drive shaft while causing the drive gears to be positively driven by the drive shaft. Similarly, the idler gears 54 and 56 which mesh with the drive gears 50 and 52 respectively are mounted for axial movement along the idler shaft 24. Thus the meshed drive and idler gear pairs can move axially relative to each other, and there can also be limited axial movement between a meshed drive and idler gear.

The idler gears 54 and 56 could be mounted to rotate freely around the idler shaft 24, but ideally, to reduce friction between the idler gears and the idler shaft, the idler shaft should rotate with the idler gears but still permit the idler gears to float relative to the radius of the idler shaft as well as axially. To accomplish this, a pin 57, which may be a spring pressed pin, is mounted on the idler shaft 24 and fictionally engages one of the idler gears 54 or 56. The pin may be solid or spring, pressed or floating in idler shaft. The significant characteristic is that in contacting the gear it does not restrict axial movement of the gear on the shaft. In FIG. 1, the pin engages the idler gear 56, and as this idler gear is driven by the drive gear 52, "contact" between the idler gear and the pin causes the idler shaft to rotate. However, both of the idler gears 54 and 56 can still rotate relative to the idler shaft.

As illustrated by FIG. 3, an important feature of the present invention is to prevent the split drive and idler gears from being compressed together by axial loads on the shafts 20 and 24, thereby preventing the drive and idler gears from achieving free movement axially of the shafts. Most gear pumps are designed such that there is an axial load on the drive shaft 20 due to the fact that one end of the drive shaft with drive coupling 22 is in the crankcase of an external drive assembly and is exposed to atmospheric pressure or a positive pressure while the opposite end is exposed to pump suction or some different pressure. Thus in the operation of the gear pump 10, the drive shaft is loaded to the right in FIG. 1. If the split gears are left free to float between two snap rings placed on the drive shaft externally of the split gears to capture the gears between the snap rings, axial loading of the shaft will compress the two gears together to inhibit axial movement of the gears. This then permits fluid to leak around at least one outer end of the gears between the gears and a chamber endwall 16.

Normally, the idler shaft of a gear pump is balanced in an axial direction. However, in the gear pump 10, the idler shaft 24 is axially loaded to the right in FIG. 1. This is accomplished by providing a chamber 59 at the left end of the idler shaft in FIG. 1 and by connecting the chamber 59 to the bearing cavity 61 for the drive shaft bearings. The operation of the drive gears 50 and 52 pressurize the bearing cavity 61, to pass into the chamber 59 to create a positive pressure on the left end of the idler shaft, while the right end of the idler shaft is subjected to the suction present in the end chamber 43.

In accordance with the present invention, a single snap ring 60 is positioned on the drive shaft 20 between the drive gears 50 and 52 and a single snap ring 61 is positioned on the idler shaft 24 between the idler gears 54 and 56. No external snap rings or other retainers are mounted on the drive and idler shafts between the outer ends of the drive and idler gears and the pump chamber endwalls 16 and 18. The snap rings 60 and 61 permit the drive gears 50 and 52 and the idler gears 54 and 56 to separate and provide end face sealing even in cases where the shafts are axially biased. These single, internally positioned snap rings carry the axial load through to the rear gears (52 and 56) alone which are pressed by such load against the adjacent endwall 18 of the pump chamber 14. This creates a seal in a manner to be described between the gears 52 and 56 and the endwall 18, but leaves the gears 50 and 54 free to float, separate, and create a seal with the chamber endwall 16.

The drive gears 50 and 52 are counterbored at 63 and 65 to receive the snap ring 60 while the idler gears 54 and 56 are counterbored at 67 and 69 to receive the snap ring 61. This permits the gears to move together to close the central gap therebetween. The snap rings 60 and 61 may be replaced with either resilient O rings or spring type washers mounted in the counterbores 63, 65, 67 and 69 to bias the gears apart but which permit the gears to float together against the bias.

In cases of O ring or spring-type washer, these components provide gear separation force necessary to overcome gear compression force caused by axial shaft bias working through externally located snap ring.

Figure 4A:
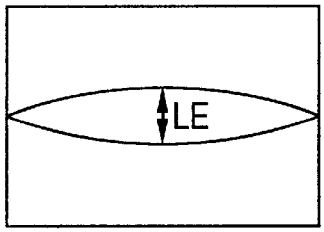
FIG. 4*a* is a diagram of other possible lead error.
Figure 4:
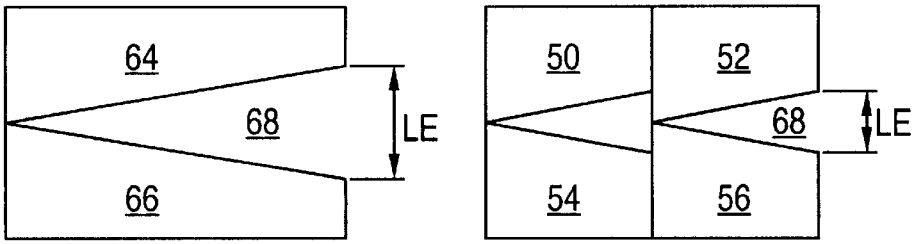
FIG. 4 is a diagram illustrating the gear teeth lead error leakage improvement provided by the gear pump of the present invention.

Referring now to FIG. 4, a conventional gear pump includes a single drive gear 64 in place of the split drive gears 50 and 52 and a single idler gear 66 in place of the split idler gears 54 and 56. When single drive and idler gears are used to move fluid between the low pressure and high pressure sections of the pump chamber, the pressure gradient between these sections causes fluid to leak internally through clearances between the teeth of the meshing drive and idler gears. These clearances are formed by gear tooth manufacturing lead error which is waviness or profile error of the involute along the length of the gear to provide a leak path. Where a single unitary drive gear 64 and a single unitary idler gear 66 fixed to the drive and idler shafts are employed, a leakage clearance area 68 between meshed teeth of the two gears is defined by the lead error LE. Lead error induced clearance and therefore leakage area increases with axial gear length as shown in FIG. 4. FIG. 4 is only a representation for lead error geometry. Other geometries exist as illustrated in FIG. 4*a* but the end effects are independent of precise lead error geometry.

When the unitary drive and idler gears 64 and 66 are replaced by the split drive gears 50 and 52 meshing with the split idler gears 54 and 56 to form a pump gear assembly of a size identical to that formed by the unitary drive and idler gears, the leakage clearance area 68 decreases. The split gear concept wherein each gear is shiftable axially independent of the remaining gears reduces the lead error LE by allowing gear teeth of each gear set to mesh and shift axially to seal against each other independent of the remaining gear set. Powder metal formed drive gears 50 and 52 and idler gears 54 and 56 typically yield lower lead errors per unit length on gears of such reduced length, and are ideal for use in the gear pump 10.

FIGS. 1 and 5 illustrate a second way in which the floating split gears of the present invention significantly reduce fluid leakage between the low pressure and high pressure chamber sections or ports 40 and 42 to improve the volumetric efficiency of the gear pump 10. When unitary drive and idler pump gears 64 and 66 are used in a gear pump, an end clearance 70 exists at both ends of the gear set and one of the pump chamber endwalls 16 or 18. In the central chamber section 38 where the unitary drive and idler pump gears mesh, the rotating end surfaces of the gear set are moving in a direction indicated by the arrow 72 which is opposite to the direction of leakage fluid flow indicated by the arrow 74 through each end clearance 70. However, the endwalls 16 or 18 which also form boundaries for the end clearance 70 are stationary, so that fluid leakage occurs along the stationary endwall through the end clearance 70.

Figure 2:
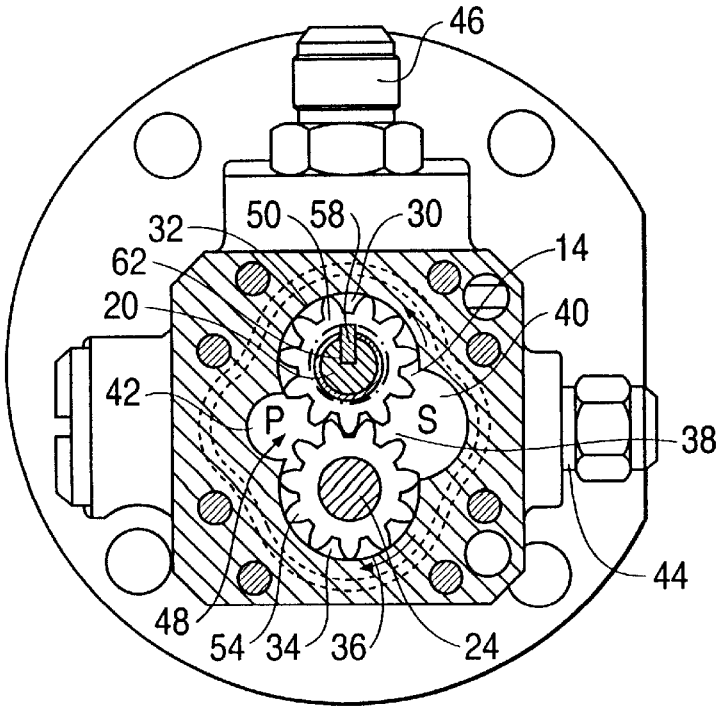
FIG. 2 is a cross sectional view of the gear pump of FIG. 1.

When the floating split pump gear assembly 48 of the present invention replaces the unitary drive and idler pump gears 64 and 66, gear end clearance 70 initially exists at both outside ends of the split gear sets and still another end clearance 76 exists between the gear sets. As the pump drive gears 50 and 52 and the pump idler gears 54 and 56 rotate in a counterclockwise direction in FIG. 2, fuel is drawn from the low pressure section or port 40 and carried by the pump drive gears which engage the peripheral wall 32 and the pump idler gears which engage the peripheral wall 36 around the respective peripheral walls to the high pressure chamber or port 42. This action causes the fuel to be pressurized prior to exiting the pump from the high pressure chamber. Normally, if the split gear sets were fixed on the drive and idler shafts 20 and 24, the pressure gradient between the low pressure and high pressure chambers 40 and 42 would result in leakage through the gear end clearances 70 as well as to a lesser extent through the end clearance 76. Also, fixed split gears cannot independently shift axially to seal and thereby reduce leakage due to gear lead error. However, since the split gear sets of the gear pump 10 float axially on these shafts, it will be noted that end clearance 76 is bounded by gear faces moving at the same speed so that the relative velocity between the gear faces on opposite sides of the end clearance 76 is zero. Conversely, the end clearances 70 are each bounded by moving gear faces on one side and a stationary endwall 16 or 18 on the opposite side. Axial separation allowed for by use of internal snap ring causes substantially all of the end clearance to exist at 76, and it will be noted that in the central chamber section 38, the gear faces on opposite sides of the end clearance 76 are both moving in a direction indicated by the arrows 78 opposite to the direction of fluid leakage flow indicated by the arrow 80. This inhibits the leakage flow through the end clearance 76 while there is little or no leakage flow through the end clearances 70. In operation, the leakage flow through the end clearance 76 with the floating split gear sets is much less than the leakage flow which occurs through the end clearances 70 when the unitary drive and idler gears 64 and 66 are employed. The restriction caused by the gear bore to shaft clearance additionally restricts leakage through the end clearance 76. Thus the use of the axially floating, split pump drive and idler gears of the present invention reduces both leakage due to gear tooth lead error and end clearance leakage to provide a gear pump having enhanced volumetric efficiency.

Industrial Applicability

The high efficiency gear pump incorporates axially floating split gear sets which permit the pump to pressurize and pump fluid while minimizing internal fluid leakage which degrades the volumetric efficiency of the pump. Leakage due to both gear tooth lead error and end clearance is reduced through the use of the axially floating split gear sets.

What is claimed is:

1. A gear pump for pressurizing and pumping fluid comprising:

a pump housing having an inlet port section, and an outlet port section spaced from said inlet port section;

a fluid pump chamber formed in said pump housing having first and second spaced endwalls;

a meshed gear pumping assembly mounted in said fluid pump chamber between said inlet port section and said outlet port section to pump fluid from said inlet port section to said outlet port section, said meshed gear pumping assembly including a first shaft mounted for rotation on said pump housing to extend between said first and second spaced endwalls;

a second shaft mounted on said pump housing to extend between said first and second spaced endwalls in substantially parallel spaced relationship to said first shaft;

first and second pump gears coaxially mounted in said first shaft, a first separator unit secured to said first shaft between said first and second pump gears, said first shaft and first pump gear being formed to provide a drive connection and to mount said first pump gear for rotation with said first shaft and for free axial movement along said first shaft between said first separator unit and said first endwall and said first shaft and second pump gear being formed to provide a drive connection and to mount said second pump gear for rotation with said first shaft and for free axial movement along said first shaft between said first separator unit and said second endwall;

third and fourth pump gears coaxially mounted for rotation on said second shaft to separately mesh with said first and second pump gears respectively;

a second separator unit secured to said second shaft between said third and fourth pump gears, said second shaft and third pump gear being formed to mount said third pump gear for free axial movement along said second shaft between said second separator unit and said first endwall and said second shaft and fourth pump gear being formed to mount said fourth pump gear on said second shaft for free axial movement along said second shaft between said second separator unit and said second endwall, said first and second pump gears each includes an inner gear face with the inner gear face of said first pump gear being adjacent to the inner gear face of said second pump gear, the inner gear face of at least one of said first and second pump gears being formed with a first indented snap ring receiving chamber adjacent to said first shaft, said first separator unit including a first snap ring connected to said first shaft and received in said first indented snap ring receiving chamber, and said third and fourth pump gears each include an inner gear face with the inner gear face of said third pump gear being adjacent to the inner gear face of said fourth pump gear, the inner gear face of at least one of said third and fourth pump gears being formed with a second indented snap ring receiving chamber adjacent to said second shaft, said second separator unit including a second snap ring connected to said second shaft and received in said indented snap ring receiving chamber.

2. The pump of claim 1 wherein said first shaft is a driven shaft mounted for rotation on said pump housing, said drive connection being formed to connect said first and second pump gears to said first shaft to be positively rotated by said first shaft, said drive connection permitting axial movement between said first and second pump gears and said first shaft.

3. The gear pump of claim 2 wherein the axial length of said first, second, third and fourth pump gears is substantially equal.

4. The gear pump of claim 1 wherein said third and fourth pump gears are mounted for rotation relative to said second shaft.

5. The gear pump of claim 4 wherein a slip connector unit is provided between said second shaft and at least one of said third and fourth pump gears to cause rotation of said second shaft upon rotation of the third and fourth gear pumps but still permitting rotation of said third and fourth pump gears relative to said rotation second shaft.

6. The gear pump of claim 5 wherein said slip connector unit is a spring pressed pin mounted on at least one of said third and fourth pump gears which engages and slides on said second shaft.

7. The gear pump of claim 4 wherein said meshed first and third pump gears are axially movable on said first and second shafts relative to and separate from said meshed second and fourth pump gears and said meshed second and fourth pump gears are axially movable on said first and second shafts relative to and separate from said meshed first and third pump gears, said first and third pump gears being axially and separately movable relative to each other on the first and second shafts respectively and said second and fourth pump gears being axially and separately movable relative to each other on the first and second shafts respectively.

8. The gear pump of claim 7 wherein said pump chamber includes a first gear section having a first arcuate wall extending between said inlet and outlet port sections and a second gear section opposed to and spaced from said first gear section, said second gear section having a second arcuate wall extending between said inlet and outlet port sections, the first and second pump gears being mounted for rotation with minimal clearance with said first arcuate wall and the third and fourth pump gears being mounted for minimal clearance with said second arcuate wall, said first and third and second and fourth pump gears meshing in said pump chamber between said first and second gear sections.

9. The gear pump of claim 8 wherein said first and second shafts extend through and outwardly beyond said first endwall, said pump housing including a bearing chamber which receives said first shaft outwardly from said first endwall and a shaft cavity to receive an end of said second shaft outwardly of said first endwall, said shaft cavity being connected to said bearing chamber.

10. The gear pump of claim 1 wherein said first and second shafts extend through and outwardly beyond said first endwall, said pump housing including a bearing chamber which receives said first shaft outwardly from said first endwall and a shaft cavity to receive an end of said second shaft outwardly of said first endwall, said shaft cavity being connected to said bearing chamber.

11. The gear pump of claim 10 wherein said third and fourth pump gears are mounted for rotation relative to said second shaft.

12. The gear pump of claim 11 wherein said first shaft and first and second drive gears are formed to provide a drive connection which is a slot and key combination.

* * * * *